US010335333B2

(12) United States Patent
Ertelt

(10) Patent No.: US 10,335,333 B2
(45) Date of Patent: Jul. 2, 2019

(54) MECHANICS OF THE BED SIDERAIL

(71) Applicant: LINET SPOL. S R.O., Slany (CZ)

(72) Inventor: Martin Ertelt, Fulnek (CZ)

(73) Assignee: LINET SPOL. S R.O., Slany (CZ)

( * ) Notice: Subject to any disclaimer, the term of this patent is extended or adjusted under 35 U.S.C. 154(b) by 227 days.

(21) Appl. No.: 15/105,371

(22) PCT Filed: Dec. 30, 2014

(86) PCT No.: PCT/CZ2014/000165
§ 371 (c)(1),
(2) Date: Jun. 16, 2016

(87) PCT Pub. No.: WO2015/101369
PCT Pub. Date: Jul. 9, 2015

(65) Prior Publication Data

US 2016/0310336 A1 Oct. 27, 2016

(30) Foreign Application Priority Data

Dec. 30, 2013 (CZ) ..... 2013-1074

(51) Int. Cl.
*A61G 7/05* (2006.01)
*A47D 7/02* (2006.01)
*A61G 7/018* (2006.01)

(52) U.S. Cl.
CPC ..... *A61G 7/0507* (2013.01); *A47D 7/02* (2013.01); *A61G 7/018* (2013.01); *A61G 7/052* (2016.11);
(Continued)

(58) Field of Classification Search
CPC . A47D 7/00; A47D 7/02; A47D 11/05; A47D 11/007; A47D 13/06; A47D 13/065;
(Continued)

(56) References Cited

U.S. PATENT DOCUMENTS 3,063,066 A * 11/1962 Peck ..... A61G 7/0507 5/100
3,840,917 A * 10/1974 Taylor ..... A61G 7/0507 5/100
(Continued)

FOREIGN PATENT DOCUMENTS

GB 967461 A 8/1964

OTHER PUBLICATIONS

World International Property Organization (WIPO), International Search Report in International Application No. PCT/CZ2014/000165, filed Dec. 30, 2014, dated Dec. 15, 2015.
(Continued)

*Primary Examiner* — Nicholas F Polito
(74) *Attorney, Agent, or Firm* — Thedford I Hitaffer; Hitaffer & Hitaffer, PLLC

(57) ABSTRACT

A bed with telescopic siderail including two mutually engaging parts and a linkage. The linkage is formed by the first arm and second arm, slider and slider housing. The first arm is connected to the bed frame approximately in the center, while the second arm is connected by its one end to the bed frame and its other end is connected to a joint bushing. The upper section of the siderail frame includes locking mechanism with at least two safety members.

17 Claims, 4 Drawing Sheets

(52) U.S. Cl.
CPC ..... *A61G 7/0509* (2016.11); *A61G 7/0515* (2016.11); *A61G 7/0516* (2016.11); *A61G 2200/14* (2013.01)

(58) Field of Classification Search
CPC .. A47D 13/068; A61G 7/0507; A61G 7/0508; A61G 7/0509; A61G 7/0515; A61G 7/0516; A61G 7/052; A61G 7/0521; A61G 13/105; A61G 1/04; A61G 2200/14; A61G 7/05; A61G 7/018; A47C 21/089
USPC ..... 5/100
See application file for complete search history.

(56) References Cited

U.S. PATENT DOCUMENTS 5,926,870 A * 7/1999 Branca-Barnes ..... A47D 7/02 5/100
6,351,861 B1 * 3/2002 Shows ..... A61G 7/012 5/613
6,473,922 B1 * 11/2002 Sommerfeld ..... A61G 7/012 5/610
6,681,424 B1 * 1/2004 Bourgraf ..... A61G 1/0562 5/607
2001/0032362 A1 * 10/2001 Welling ..... A61G 7/0528 5/600
2003/0167568 A1 * 9/2003 Brooke ..... A61G 7/00 5/430
2003/0177578 A1 * 9/2003 Nixon ..... A47D 7/02 5/429
2008/0066230 A1 * 3/2008 Hallock ..... A61G 7/012 5/600
2009/0070928 A1 * 3/2009 Huang ..... A61G 7/012 5/11
2013/0318720 A1 * 12/2013 Connell ..... A61G 7/018 5/611
2015/0033472 A1 * 2/2015 Li ..... A61G 7/015 5/11

OTHER PUBLICATIONS

World International Property Organization (WIPO), Written Opinion of the International Searching Authority in International Application No. PCT/CZ2014/000165, filed Dec. 30, 2014, dated Dec. 15, 2015.

* cited by examiner

MECHANICS OF THE BED SIDERAIL

CROSS-REFERENCE TO RELATED APPLICATIONS

This application, filed under 35 USC 371, is a United States National Stage Application of International Application No. PCT/CZ2014/000165, filed Dec. 30, 2014, which claims priority to CZ Application No. PV 2013-1074, filed on Dec. 30, 2013, the disclosures of which are incorporated herein by reference.

TECHNICAL FIELD

The invention is related to the siderail of a bed such as a hospital bed, nursing bed, examination bed, stretcher etc. The siderail is movable in such a way that when in the upper position, the siderail can prevent the patient from falling, and in the lower position it enables the patient to leave the bed. The siderail includes a mechanism for locking in one of the desired positions, and it is unique in that it is connected to a linkage.

BACKGROUND ART

A majority of available hospital beds designed to keep the patient in the horizontal position is equipped with a positioning patient support, headboards in the head and foot sections of the bed and siderails. Siderails, especially those installed on cribs, must meet several safety requirements. The siderails must cover the entire side section of the patient support in order to prevent the patient from falling, they must enable positioning to at least two positions and, at the same time, they must include a mechanism to lock the siderail in the safe upper position. This mechanism prevents the child patient from disengaging the siderail.

First solutions of the locking mechanism for locking the siderail in the upper position is described, for example, in patent GB152120. Thanks to this solution, the siderail can be moved from the upper to the lower position, where the siderail is approximately at the level of the patient support. However, this mechanism is not absolutely safe, and the siderails might be folded by the patient.

Some of the other problems mentioned above are solved by a mechanism of tubular telescopic siderails which get engaged to each other when the siderail is being folded, and, at the same time, this assembly of mutually engaged siderails can be folded below the level of the patient support. This state of the art has been known for a long time, and it is described, for example, in patent GB637951. This type of siderails, though, can cause an injury to the patient. Another disadvantage of this solution is the fact that manipulation with these siderails can be difficult due to their significant weight.

A frequent issue with the currently used solutions is the already mentioned difficult manipulation with the siderails caused by a reason other than their weight. The siderails are integrated in guide rails of special corner posts. This leads to a problem with balancing the siderails. If the personnel wants to lift the siderail, they must apply balanced force on the upper frame to prevent the siderail from getting stuck. The guide rail limits the range within which the siderail can move. If the siderail is to be folded down to the level of the patient support, the posts with the guide rail must extend below the patient support level. Moreover, the necessity to use such extended guide posts significantly limits the range of elevation of the upper frame with the patient support.

Another solution of the guiding mechanism is described, for example, in patent U.S. Pat. No. 6,772,459, in which a third frame is installed between the upper and lower frame of the siderail, securely mounted to the patient support and limiting the movement of the siderail between the safe upper position and the lower position.

The objective of this invention is to design telescopic siderails in a way that would meet all the above stated safety requirements. On the other hand the corner posts with the guide rail into which the bed siderail is inserted should not limit the lift of the patient support. A siderail should not get stuck in the guide rail under any circumstances, its lowering and lifting should be safe for the patient and as easy and as most comfortable as possible for personnel. Also, a siderail should include a safe mechanism for locking in the upper position that would be very difficult for a child patient to unlock.

SUMMARY OF THE INVENTION

The aforementioned issues are solved by a bed with telescopic siderails such as a hospital bed, nursery bed, examination bed, stretcher etc. The bed siderail includes two mutually engaging parts and is unique in that it includes a linkage, formed by the first and second arm, a slider and slider housing. The first arm is connected to the bed frame approximately in the centre, while the second arm is connected by its one end to the bed frame and its other end is connected to a joint bushing.

A spring is connected to the linkage and balances the movement of the siderails during lowering and lifting in order to prevent the siderails from getting stuck and, at the same time, it absorbs impacts during lowering of the siderail. When the whole assembly of the mutually engaged parts of the siderail is being lowered, this movement is transferred to the translation movement of the slider by means of the linkage.

The upper section of the siderail frame includes a locking mechanism with at least two safety members. The user must overcome both these safety members in order to lower the siderail or to lift it to a new position. In addition to the locking mechanism, the siderail also includes gliders by means of which it moves in the guide rails of the bed corner posts.

DETAILED DESCRIPTION OF THE DRAWINGS

Figure 1:
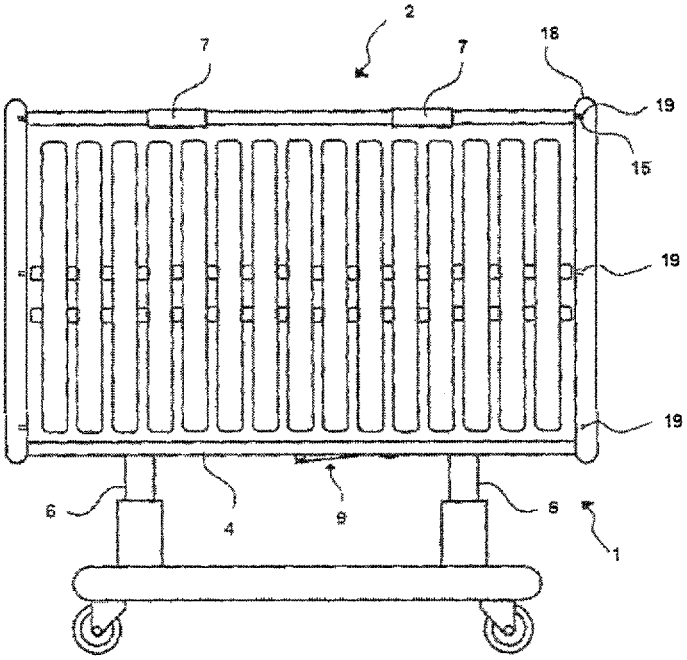
FIG. 1 shows the side view of the child bed with the telescopic siderails.

FIG. 1 shows the bed 1 with telescopic siderails 2. The bed 1 includes patient support 3, bed frame 4, headboard, footboard and the telescopic siderails 2. The patient support 3 can be positioned as a whole, for instance into the Trendelenburg position, or the individual sections of the patient support 3 can be tilted separately. The patient support 3 includes the extensible auto-regressive middle section which maintains a constant space between the headboard and the patient support 3 during positioning of the head section of the patient support 3 in order to prevent the patient from falling into the space created by positioning of the patient support 3.

Positioning of the upper frame 4 of the bed 1, and hence the entire bed 1, is enabled by two positioning columns 6 onto which the patient support 3 is installed. In an alternative solution, the columns 6 are replaced by a scissor lifting mechanism controlled by linear units.

Figure 2:
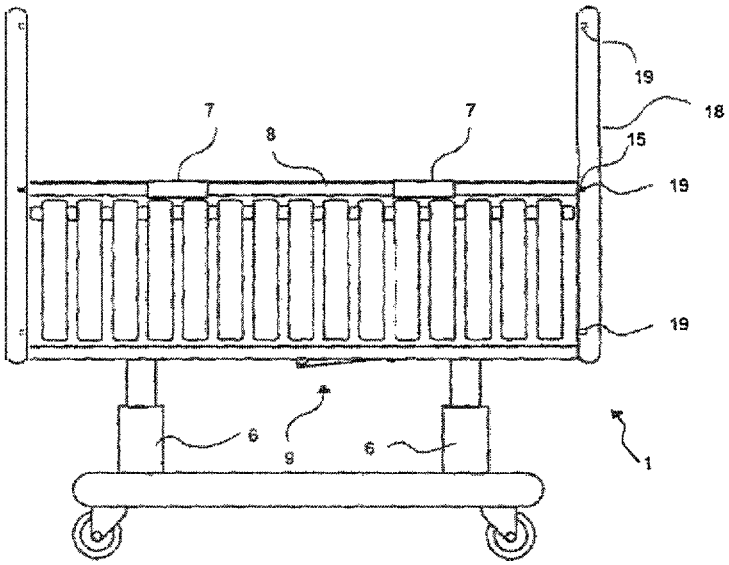
FIG. 2 shows the bed siderail in the middle position.

In FIG. 1, the siderail 2 is positioned in the upper position which is safe for the patient. The siderail 2 can be lowered to the medium position, as shown in FIG. 2, where it serves as a supporting device for child patients and the safety of the patient is not jeopardized by possible falling from the bed 1. The lower position, in which the siderail 2 is approximately at the level of the patient support 3 (shown in FIG. 3) is benefiting for personnel's handling of the child patient or, for example, for changing bedsheets. The siderail 2 is locked in the required position by means of the locking mechanism 7. This mechanism includes two safety members which must be overcome simultaneously in order to release the siderail 2 and to change its position. As shown in FIG. 1, these safety members are sufficiently distant from each other, making it impossible for a child patient to unlock the siderail 2 from its safe upper position. The siderail moves between the individual positions defined by the number of the locking stops 19 by means of the sliders 15 inserted in the guide rails of the corner posts 18. The number of positions where the siderail 2 can be locked is not limited by this invention. An ordinary expert skilled in the art of hospital beds knows how additional locking stops 19 for other requested positions can be created.

The tubular siderail 2 according to the invention combines plastic and aluminium materials. The siderails 2 can be made either of plastic material only, wood, another metal or a metal alloy to achieve a higher durability. The siderail 2 can be lowered to the medium position upon unlocking the locking mechanism 7, and during this movement, the upper part of the siderail 2 inserts into the lower part. When the siderail 2 is being folded into the position where the upper part of the frame 8 of the siderail 2 is approximately at the level of the patient support 3, the entire assembly of the parts of the siderail 2 inserted in one another performs the movement. Attached to the lower part of the frame 8 of the siderail 2 is a joint by means of which the bottom part of the siderail 2 is connected to the bed 1.

Figure 5:
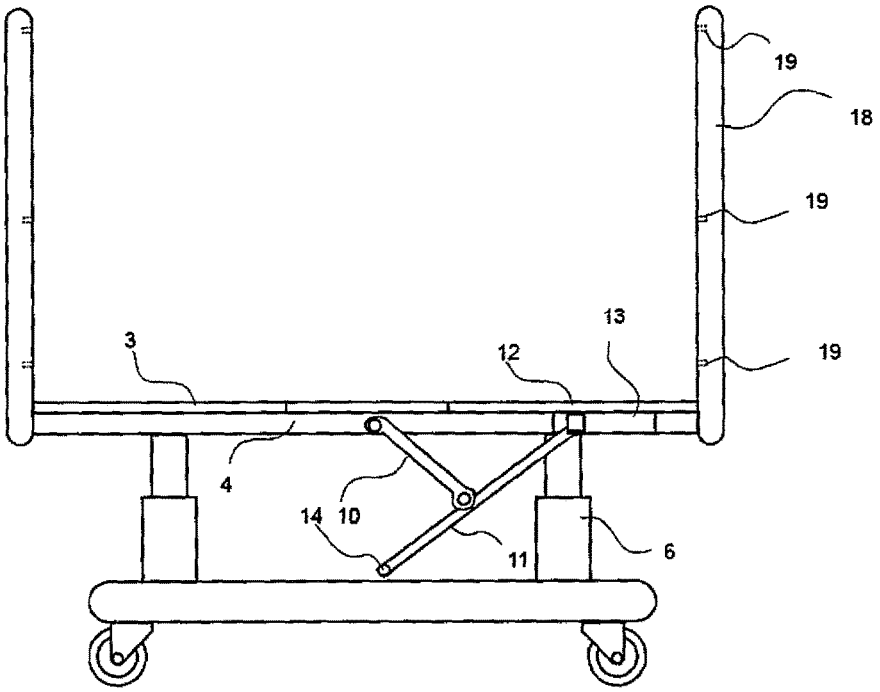
FIG. 5 shows the linkage when the siderail is in the lowest position.
Figure 6:
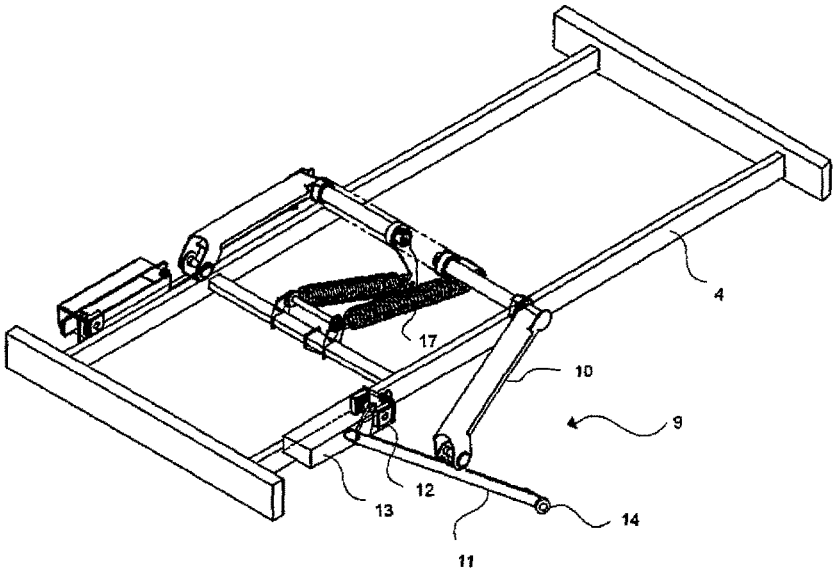
FIG. 6 shows a detailed angle view of the connection of the linkage and the spring.
Figure 7:
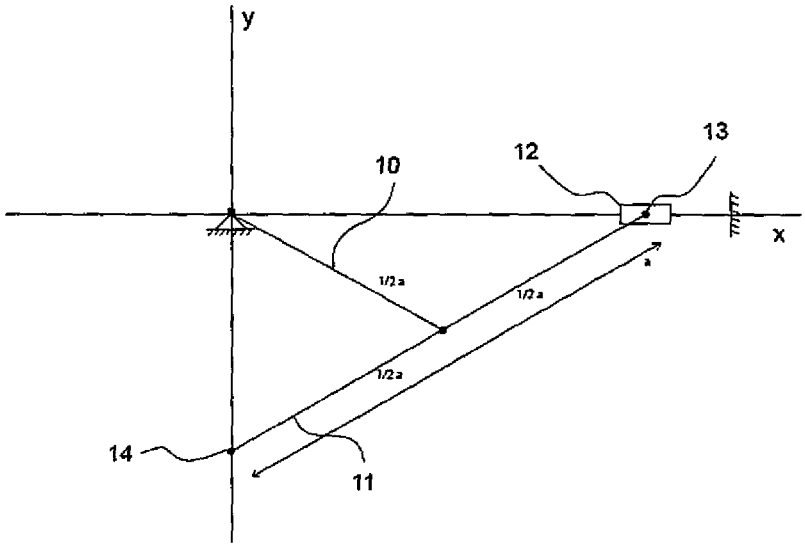
FIG. 7 shows a kinematic model of the linkage.

To enable comfortable handling of the siderails 2, the solution according to this invention includes the rotary linkage 9. This linkage 9 includes the first arm 10 and the second arm 11. The first end of the first arm 10 is rotationally connected to the frame 4 of the bed 1 approximately at the point of the transverse plane intersecting the centre of the lower part of the frame of the siderail 2. For the purposes of this invention, the phrase "at the point of the transverse plane" shall mean on the plane, with a tolerance of 5 cm. The second end of the first arm 10 is connected to the centre of the second arm 11. The first end of the second arm 11 is connected by means of rotary sliding coupling to the slider 12 situated in the housing 13 for the slider 12. This linkage is described in FIG. 4 and FIG. 5. The second end of the second arm 11 includes the bushing 14 for the joint into which the joint of the siderail 2 is inserted. At the same time, the bushing 14 for the joint forms the central axis along which the siderail 2 moves linearly when being lowered and lifted, and, at the same time, it is one of the three points by means of which the siderail 2 is connected to the bed 1. In order for the bushing 14 of the joint to always move along the vertical axis, the first arm 10 and a half of the second arm 11 must form the arms of an isosceles triangle, i. e., the first arm 10 must be connected to the centre of the second arm 11 and its length should be a half of that of the second arm 12, as shown in FIG. 7. The remaining two connecting points are the two sliders 15 which are parts of the upper section of the frame 8 of the siderail 2, moving in the guide rail or leaning against the locking stops 19. The spring 17 is connected to the linkage 9 via a torsion mechanism, and the spring acts on the lower section of the frame 8 of the siderail 2 in a direction opposite to that of the gravity force acting on the siderail 2. This mechanism is shown in FIG. 6. In the solution according to the invention, this spring 17 is situated under the patient support 3 of the bed 1. The linkage 9 can be connected to more than one spring 17, and it need not always be under the patient support 3. But the spring 17 should always act on the siderail 2 by force whose direction is opposite to that of the gravity force acting on the siderail 2. In alternative solution the springs 17 can be integrated, for example, into the upper section of the posts 18 between which the siderail moves. A simplified kinematic model of the solution described above is shown in FIG. 7.

Figure 3:
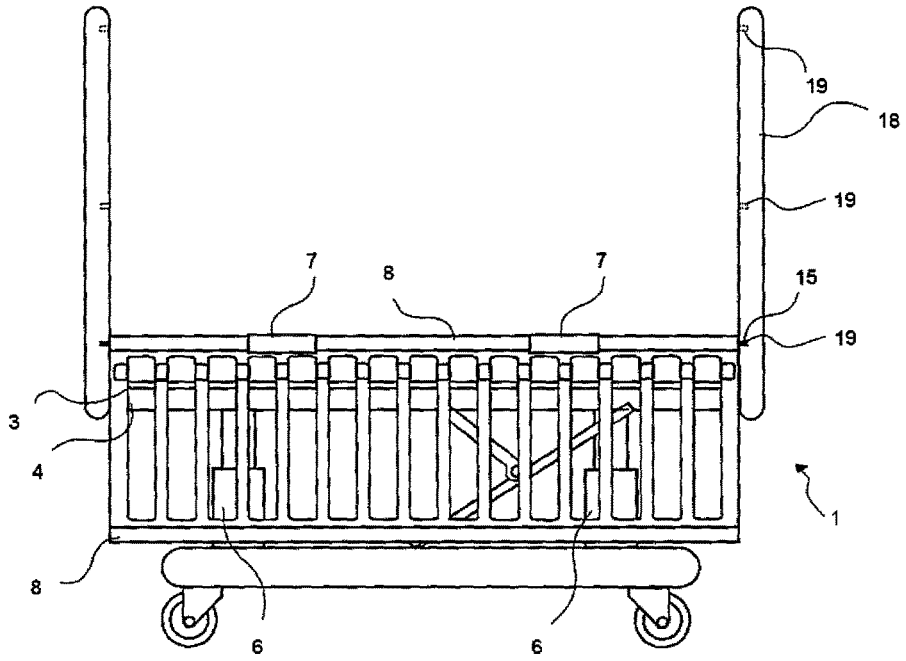
FIG. 3 shows the siderail in the lowest position, approximately at the level of the patient support.
Figure 4:
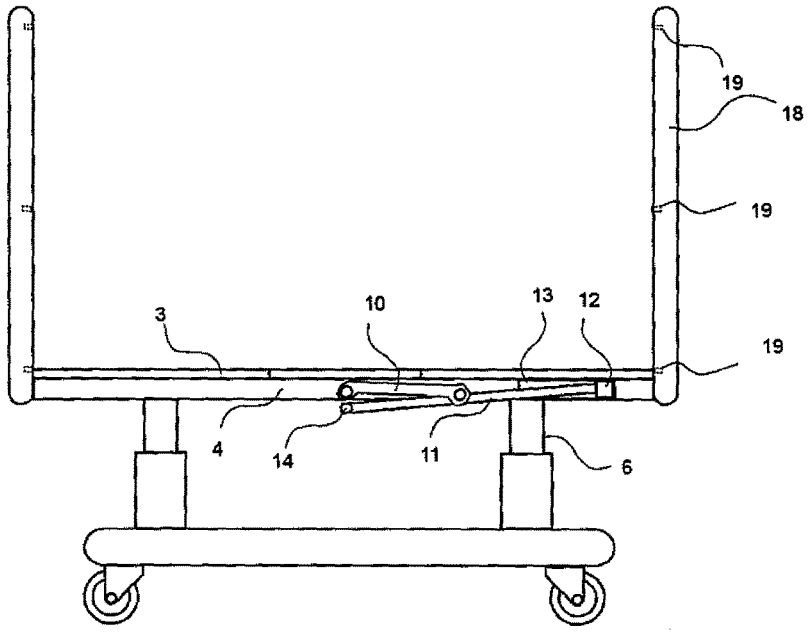
FIG. 4 shows the linkage when the siderail is in the highest or medium position.

The body of the siderail 2 includes two mutually engaging parts 20, 21 and the frame 8. This frame 8, in solution according to the invention, includes the upper and lower profile. Connected to each of these profiles is one part of the siderail 2. In an alternative solution, the frame 8 of the siderail 2 is a single piece. The spring 17 performs its function even when the siderails 2 are being lowered. If the user wishes to lower the siderail 2 into another, e.g. middle, position, they must always overcome the locking mechanism 7. Another step is inserting the upper part of the siderail 2 into the lower part to which the spring 17 is connected. From this moment on, the spring 17 acts upon the lower part of the siderail 2 by a force greater than the gravity force of this part and, therefore, the position of this part does not change even when the upper part of the siderail 2 is being inserted into it. If the siderail 2 in the middle position is unlocked, the assembly of the parts of the siderail 2 inserted into each other exerts a higher gravity force that the force with which the spring 17 acts upon the lower part of the frame 8 of the siderail 2, and, therefore, it is possible to easily slide this assembly of the folded siderails 2 into the lower position, i.e., approximately to the level of the patient support 3. FIGS. 1, 2 and 3 shows the siderail when lowered to one of the possible positions. FIGS. 4 and 5 display the movement of the linkage, occurring when the siderails are being lowered into the lower position. Courtesy to the fact that the siderail 2 is segmented, a significant saving of space is achieved and, at the same time, it doesn't interfere the personnel when performing lowering of the siderail 2. Another advantage of the segmented siderail 2 is a lower resistance encountered when only the upper part is being lowered from the upper position to the middle position. In this case, resistance is not put up by the mechanism of the siderail which is in this case the linkage 9, because lowering of the upper part doesn't depend on it.

The combination of the three-point anchoring of the siderail 2 and the integrated spring 17 means that personnel must only exert a minimum power to lift the siderail 2 into a required position. Another reason for integrating the spring 17 into the invention is its damping of the impact when the siderail 2 is being lowered into the lower positions. In an alternative solution, the siderail 2 can be integral instead of being telescopic. In this solution, the spring 2 performs the same function as in the solution described above.

Another advantage of the described solution including the linkage 9 is the fact that the entire force exerted by personnel anywhere at the siderail 2, upward or downward, is transmitted on the lower part of the frame 8 of the siderail 2 only at the point where the joint of the siderail 2 with the bushing 14 which is part of the second arm 11 of the linkage 9. Courtesy to the fact that the bushing 14 for the joint is always positioned in the vicinity of the centre of the lower part of the frame 8 of the siderail 2 and, at the same time, it is the only point by means of which the lower part of the siderail 2 is connected to the bed 1, the siderail 2 is perfectly balanced during any manipulation, preventing the siderail 2 from getting stuck during lowering or lifting; the attachment is symmetrical.

Courtesy to the fact that all force acting upon the siderail 2 is transmitted via the bushing 14 of the joint onto the linkage 9, and vice versa, there is no need to design special extended corner posts 18 or frames with guide rails to limit the movement of the siderail 2. The absence of these parts in the bed 1 significantly extends the possibility of lifting of the patient support 3 and the entire bed 2.

The invention claimed is:

1. A bed comprising:

a frame, a patient support connected to the frame, at least two posts connected on one side of the bed to the frame of the bed, at least one siderail with a frame, a locking mechanism positioned between the two posts and at least one part of the frame of the siderail, and a linkage for manipulation of the siderail with respect to the patient support, the linkage comprising a first arm and a second arm; the first arm having a first end connected in a rotating manner by a fixed pivot to the frame of the bed and a second end connected in a rotating manner to a center of the second arm; the second arm having a first end connected in a rotating manner by a sliding coupling to the frame of the bed and a second end connected in a rotating manner to the bed siderail.

2. The bed according to claim 1, wherein the second end of the second arm is connected to a lower section of the frame of the siderail.

3. The bed according to claim 2, wherein the second arm is connected to a lower section of the frame of the siderail approximately in a center of the frame of the siderail.

4. The bed according to claim 1, wherein the first arm is connected to the frame of the bed approximately in a center of the frame of the bed.

5. The bed according to claim 1, wherein the second end of the second arm is movable along a vertical axis during movement of the siderail.

6. The bed according to claim 1, wherein the linkage is connected to a spring.

7. The bed according to claim 1, wherein an upper section of the frame of the siderail comprises the locking mechanism.

8. The bed according to claim 7, wherein the locking mechanism includes at least two safety members.

9. The bed according to claim 1, wherein the siderail is formed by two mutually engaging parts to form an assembly.

10. The bed according to claim 9, wherein movement of the assembly of the mutually engaged parts of the siderail is transferred via the first arm and the second arm of the linkage to a translating movement of a slider in a housing.

11. The bed according to claim 1, wherein the posts include at least two locking stops to position the siderail.

12. The bed according to claim 1, wherein the second end of the first arm is connected directly to the center of the second arm.

13. The bed according to claim 1, wherein the second end of the second arm is connected with its second end directly to a lower section of the frame of the siderail.

14. The bed according to claim 1, wherein the first arm is connected to the frame of the bed approximately in a longitudinal center of the frame of the bed.

15. The bed according to claim 1, wherein the bed is a child's bed in the form of a crib.

16. A bed comprising:

a frame, a patient support connected to the frame, at least two posts connected on one side of the bed to the frame of the bed, at least one siderail with a frame, the siderail beingformed by two mutually engaging parts to form an assembly, a locking mechanism positioned between the two posts and at least one part of the frame of the siderail, and a linkage for manipulation of the siderail with respect to the patient support, the linkage comprisinga first arm and a second arm; the first arm having a first end connected in a rotating manner by a fixed pivot to the frame of the bed and a second end connected in a rotating manner to a center of the second arm; the second arm having a first end connected in a rotating manner by a sliding coupling to the frame of the bed and a second end connected in a rotating manner to the bed siderail, wherein movement of the assembly of the mutually engaged parts of the siderail is transferred via the first arm and the second arm of the linkage to a translating movement of a slider in a housing.

17. The bed according to claim 16, wherein the bed is a child's bed in the form of a crib.

* * * * *